United States Patent [19]

Lebessis

[11] Patent Number: 4,756,085

[45] Date of Patent: Jul. 12, 1988

[54] DEVICE FOR THE CUTTING OF WALLPAPER

[76] Inventor: Elias Lebessis, Kürfürstenstrasse 16, 8034 Germering, Fed. Rep. of Germany

[21] Appl. No.: 933,637

[22] PCT Filed: Feb. 28, 1986

[86] PCT No.: PCT/DE86/00076

§ 371 Date: Oct. 22, 1986

§ 102(e) Date: Oct. 22, 1986

[87] PCT Pub. No.: WO86/05138

PCT Pub. Date: Sep. 12, 1986

[30] Foreign Application Priority Data

Feb. 28, 1985 [DE] Fed. Rep. of Germany ..... 3507125

[51] Int. Cl.[4] ..... B26B 7/00; B26B 29/02

[52] U.S. Cl. ..... 30/272 A; 30/228; 30/286

[58] Field of Search ..... 30/247, 272 A, 272 R, 30/278, 279 R, 286, 287, 280, 295, 228

[56] References Cited

U.S. PATENT DOCUMENTS

| | | | |
|---|---|---|---|
| 2,125,556 | 8/1938 | Glesch | 30/272 R |
| 2,911,717 | 11/1959 | Knoll | 30/272 A |
| 3,006,390 | 10/1961 | Draenert . | |
| 3,009,246 | 11/1961 | Witherby | 30/286 X |
| 3,262,473 | 7/1966 | Elson | 30/295 X |
| 3,359,637 | 12/1967 | Hansen | 30/272 A |
| 3,710,445 | 1/1973 | Roth | 30/272 R X |

FOREIGN PATENT DOCUMENTS

| | | |
|---|---|---|
| 817696 | 8/1951 | Fed. Rep. of Germany . |
| 307857 | 8/1971 | U.S.S.R. . |
| 821081 | 4/1981 | U.S.S.R. . |

*Primary Examiner*—E. R. Kazenske
*Assistant Examiner*—Michael D. Folkerts
*Attorney, Agent, or Firm*—Marmorek, Guttman & Rubenstein

[57] ABSTRACT

In a device for trimming, cutting out and cutting wallpaper particularly wallpaper of any kind which has just been applied, a knife carrying out upward and downward movements and a stationary resiliently resting knife with specially formed cutting edges are installed in a multipart housing. Furthermore, in this wallpaper cutting device the two knives projecting from the housing are effectively and safely protected and covered by a covering part connected to a trigger part. For the substitution of worn out and used up parts, as knives and batteries, the housing parts of the easily, without difficulty manageable wallpaper cutting device can be easily separated from each other without the use of additional tools.

17 Claims, 8 Drawing Sheets

DEVICE FOR THE CUTTING OF WALLPAPER

Figure 1:
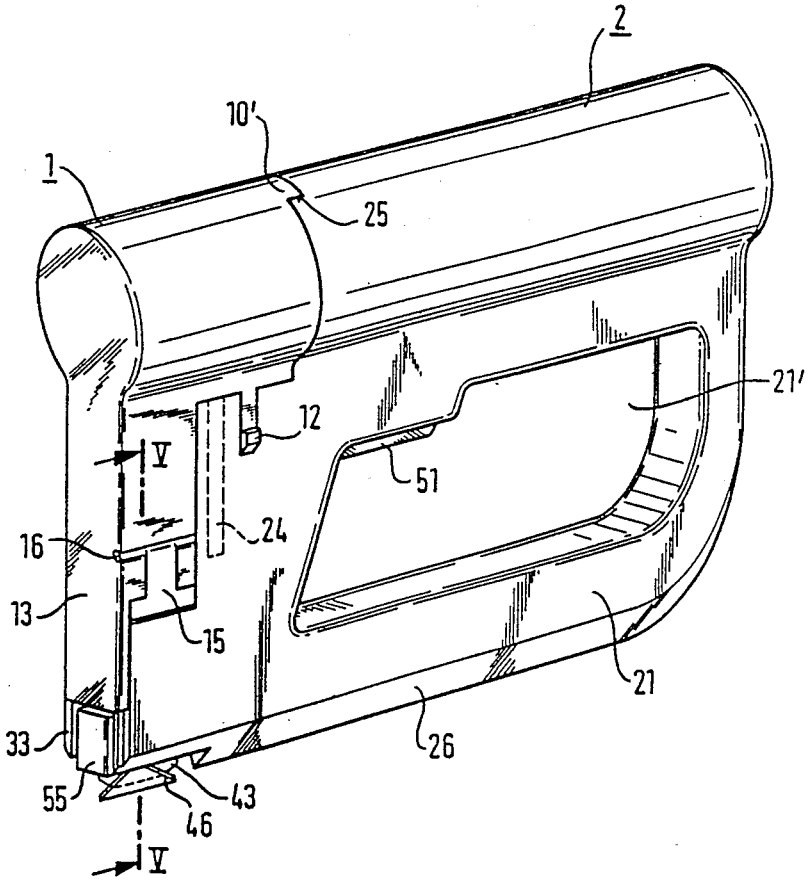

The invention relates to a device for the cutting of wallpaper, particularly of wallpaper of any kind that has just been applied to a wall according to the description of claim 1.

Since ceilings or floors are rarely exactly horizontal and parallel usually wallpaper tapes are not cut to the exact length, but always a little longer. After the wallpaper has been applied to the wall, each wallpaper tape is then marked on the upper end at the edge between wall and ceiling and on the lower end at the transition between wall and floor or skirting board, for instance with the back of a pair of scissors or a similar relatively blunt object. Then the wallpaper tape is pulled from the wall on both its ends and it is cut to length along the mark; after that the upper and lower end of the wallpaper tape which is cut to measure is reapplied on the wall.

In DE-PS No. 33 23 144, there is a description of a device for the trimming of wallpaper that has just been applied wherein a plurality of very narrow, approximately 2–3 mm wide knives are arranged parallel on a line. By means of a continuous driven chain, the plurality of knives are actuated in such a manner that within one rotation of the chain all knives are brought to cutting position one after the other by the force of a spring, the total number of knives ensuring that, as a whole, a straight cutting line is being carried out.

On the basis of the small width of the cutting edges of the knives, from the perspective of the observer seeing a wallpaper applied to the wall, a smooth cutting line, in itself straight, is achieved despite possible unevenness along the cutting edge. The cutting can be carried out not only neatly, but also within a very short period of time.

Despite these incontestable advantages, this known device has the disadvantage that, due to the plurality of knives and due to the continuous chain which is driven by a motor, it is relatively heavy and complicated in its structure and thus uneasy to handle, and that is mainly because the wallpaper that has been applied on the wall has to be cut not only at the bottom but also at the top which means that the relatively heavy device usually must be lifted overhead.

Applying wallpaper around a corner, incisions or cutouts, for example for switches, plugs, sockets, and the like, as well as preparative cutting of wallpaper tapes, cannot be carried out with the known device.

According to the invention, a light, handy and simply structured device for the cutting of wallpaper is created, by means of which wallpaper of any kind, that has just been applied can be trimmed with a smooth, neat cut corresponding to the given situation, not only at the usual transition between wall and ceiling, respectively, floor and skirting board, but also at all critical transitions, for example, between mostly perpendicular surfaces abutting mainly under a right angle, in such a manner that it fits exactly, without the wallpaper having to be removed from the wall again. Furthermore, the device according to the invention should also make it possible that incisions and cutouts can be made on the wallpaper as they are necessary, for example, for plugs, sockets or switches, or as well for ventilator covers, shutters and the like. In addition to that, the device according to the invention should be usable for preparatively cutting wallpaper tapes from wallpaper rolls.

Accordingly, this object is achieved in a device of this invention for the cutting of wallpaper of any kind.

According to a preferred embodiment of the present invention, a transfer part, driven by an eccentrically arranged pivot and carrying out an upward and downward lifting movement is arranged in a front housing part. At the end of the transfer part which turns away from the drive an exchangeable knife is attached, an equally exchangeable but stationary knife resting resiliently on it. Both knives projecting from the front housing part are covered up to the moment immediately before the turning on of the electric motor by means of a trigger part which can be shifted against the force of a spring.

In the preferred construction, the movable knife that is attached to the transfer part has at least one bevelled or rounded cutting edge on both sides, whereas the stationary knife has at least two Z-shaped zones symmetrically arranged to its center line, both bevelling parts on the Z-shaped zones being formed as cutting edges.

After the electric motor has been turned on, the knife, which is attached to the transfer part and thus is movable, carries out an upwardly or downwardly directed movement with each rotation of the motor, the movable knife sliding along the stationary knife respectively, which is resting against it under pressure. The operation of both the cutting edges of the two knives which are relatively movable towards each other, is comparable to, for instance, the operation of both cutting edges of a pair of scissors being opened and then closed. This means if, for instance, a wallpaper tape is introduced between both the cutting edges of the two knives moving towards each other and the device according to the invention is being moved perpendicularly to the wallpaper tape at the same time, the wallpaper tape will also be cut in a straight line if the device is guided in a straight way. Since the cutting edge of the firm knife has two Z-shaped zones symmetrically arranged to its center line, of which especially the bevelled parts are shaped as cutting edges, the device according to the invention can be used for cutting either by moving it towards the user or by moving it away from him. A wallpaper having been applied immediately before is lifted from the wall only to a minimal extent so that it can be brought back to its intended position by slightly pressing it against the wall.

Since a wallpaper can be easily pierced with the tip of both the Z-shaped zones, through use of the device according to the invention incisions, cutouts and the like can also be carried out at any place, particularly on wallpaper tapes that have just been applied. Due to the construction of the knives, the device can equally be used for preparatively cutting the wallpaper tapes off the wallpaper rolls.

According to a further preferred construction of the invention, the laterally viewed, almost S-shaped trigger part has a covering part with a breakthrough on the end that projects from the housing; in it both knives which are relatively movable towards each other are held in such a manner that in their resting position they are covered by the covering part in so that injuries due to the sharp cutting edges are ruled out; the covering part of the trigger part protrudes far enough over the lowest possible position of one of the two knives that its cutting edge cannot be touched.

Furthermore, a laterally viewed, L-shaped spring exerts pressure on the trigger part thus safely keeping it in its resting position, during which its front part covers the cutting edges of both knives. Furthermore, a corresponding construction of the trigger part guarantees that even if a relatively high pressure is exerted from the outside on its covering part, the trigger part remains in its rest position so that the cutting edges of both the knives are always safely covered.

Only when the trigger part of the device according to the invention is consciously operated is it drawn from its secured position into the inside of the housing against the force of the L-shaped leaf spring, whereby also a little part of the covering part is drawn inside the housing. The height of the covering part, or the depth of the slot which is provided in it, is measured in such a way that the knives project and are uncovered only immediately before the turning on of the driving motor.

Since the knives have, according to the invention, on both ends the previously described construction of the cutting edges, it is not necessary to change one knife or both when the cutting edges become dull. They only have to be turned by 180°. In order to render the turning around and the exchange of the knives easy, both the parts of the housing are so connected to each other by means of guides, grooves, hook-shaped extension pieces and latches, that, after they have been loosened they can be easily drawn out and separated.

In order to facilitate the exchange or turning around of the firm knives as well as the access to the movable knife, which is attached to the free end of the transfer part, the stationary knife is attached nonrotatably in a reception part which can be swung in relation to the front housing part. After the reception part has been swung, on the one hand the stationary knife can be either turned by 180° or exchanged, and on the other hand, an easy access to the movable knife is made possible, so that, if necessary, this can be equally either turned around or exchanged by another one.

Hereinafter the invention is explained in detail on the basis of preferred embodiments with reference to the enclosed drawings.

Figure 1A:
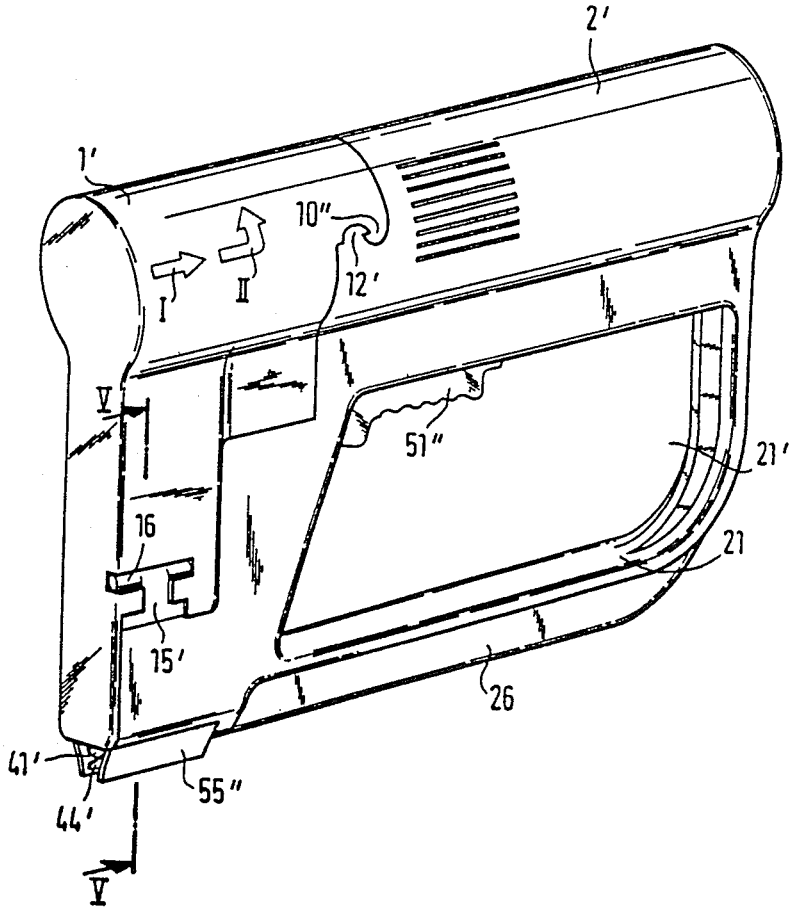
Figure 2:
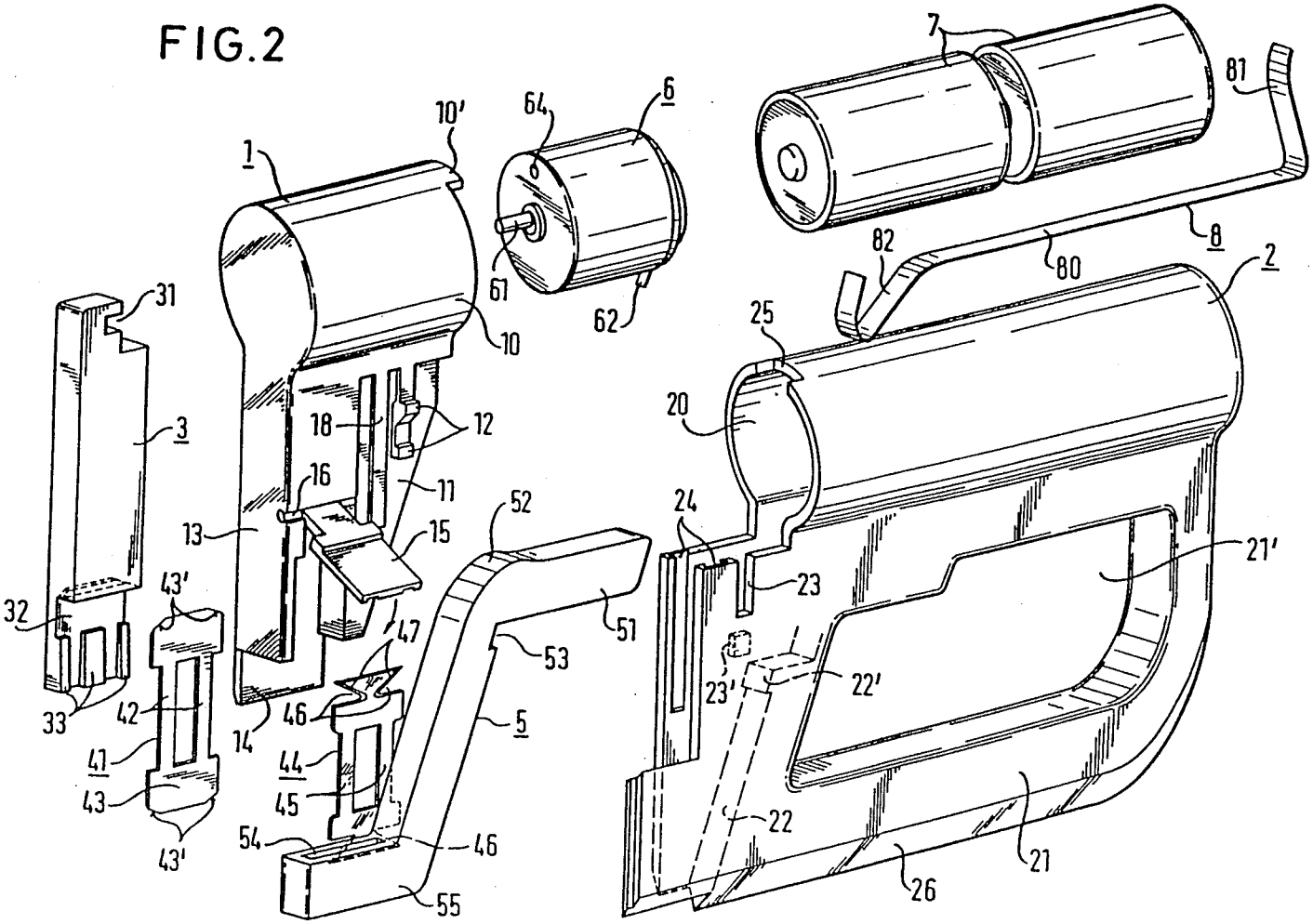
Figure 2A:
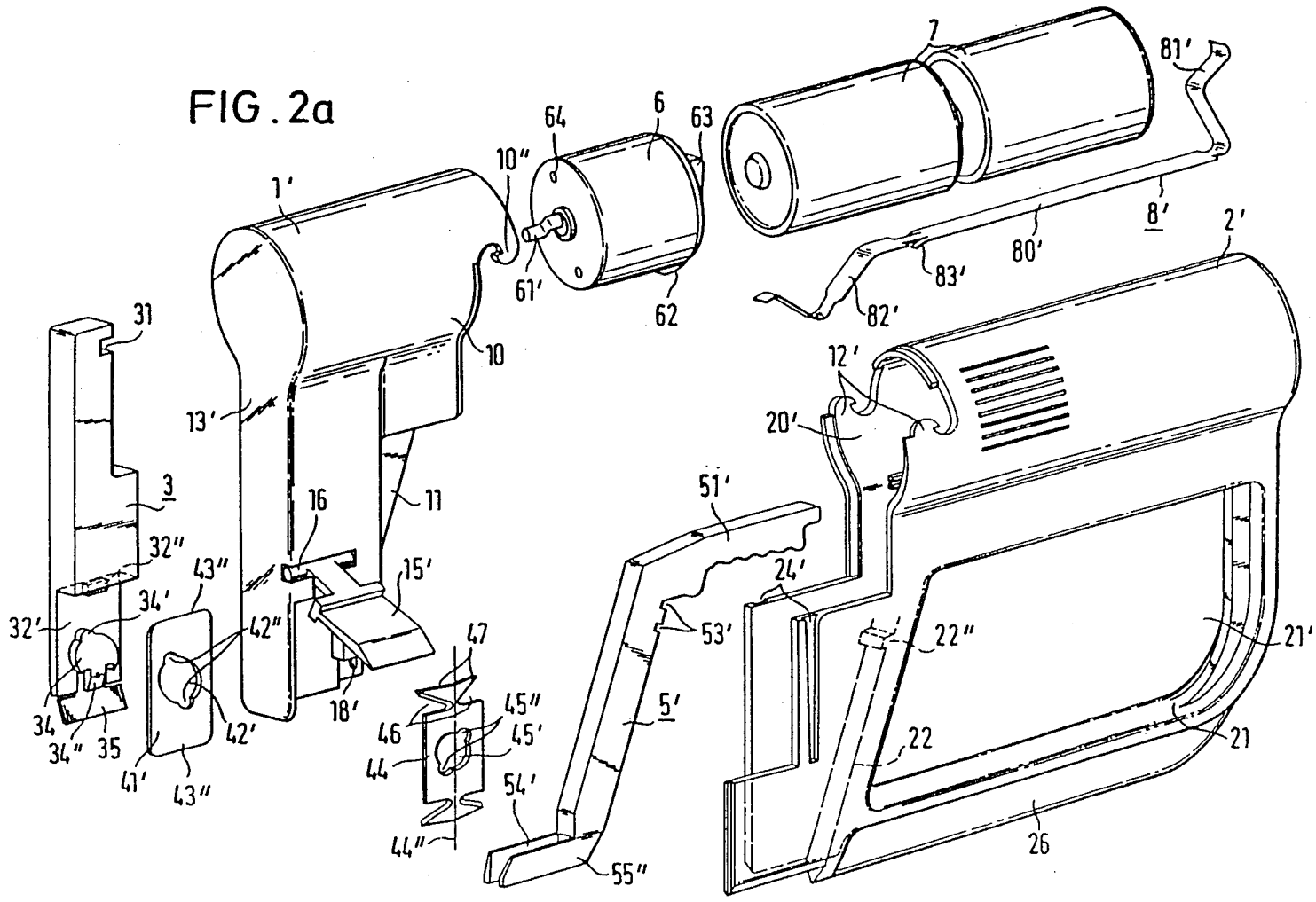
Figure 3:
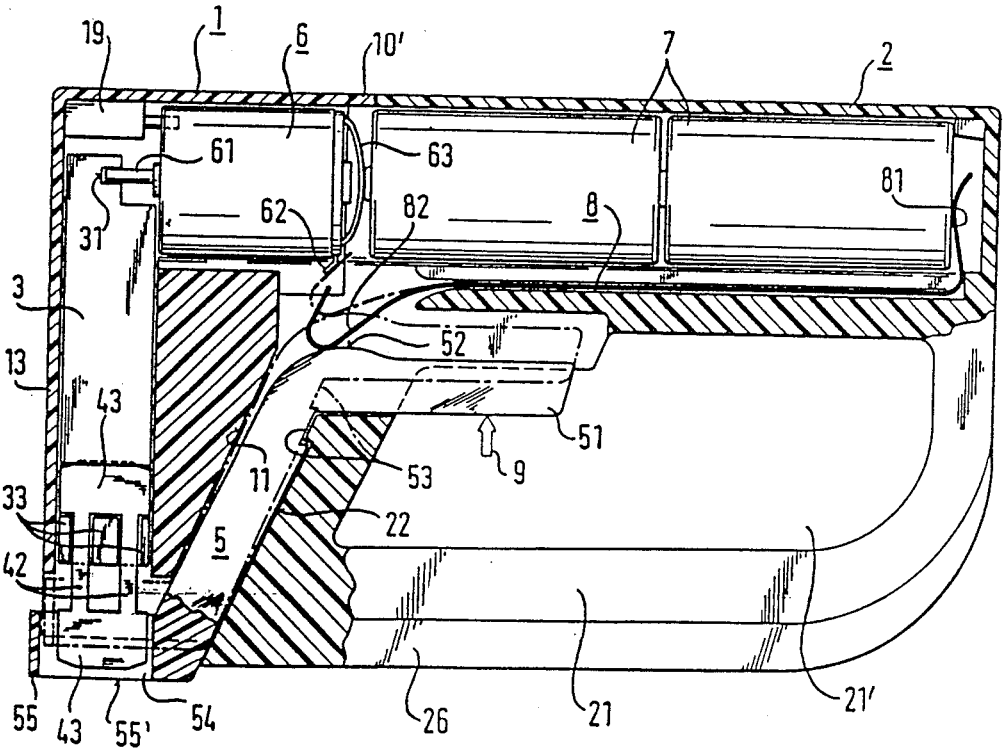
Figure 3A:
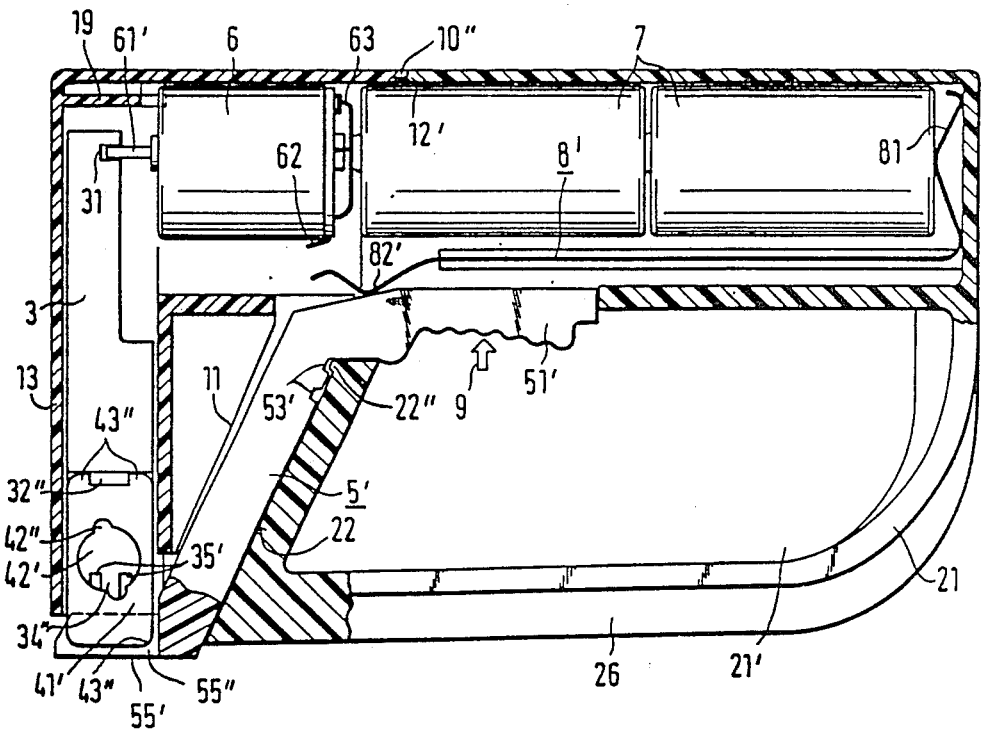
Figure 4:
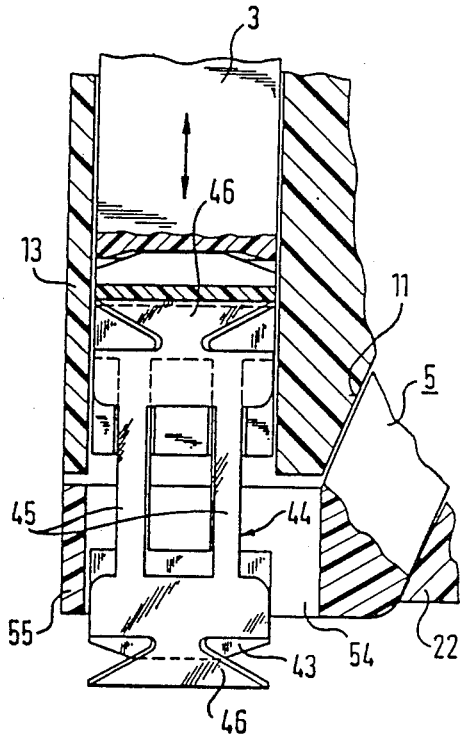
Figure 5:
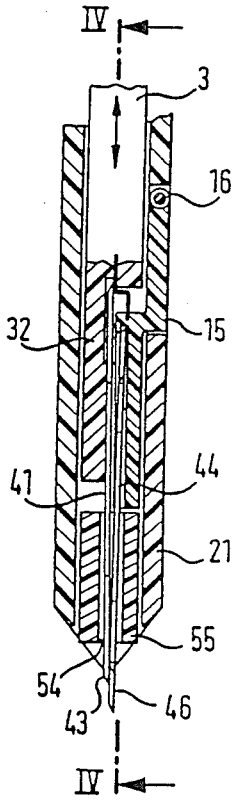
Figure 4A:
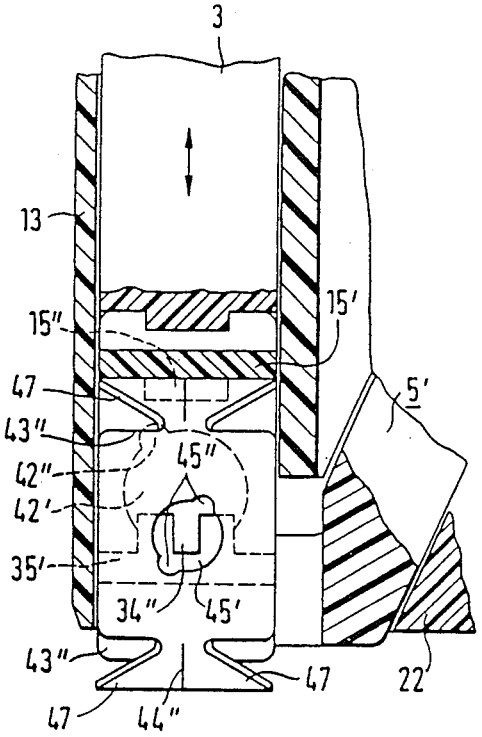
Figure 5A:
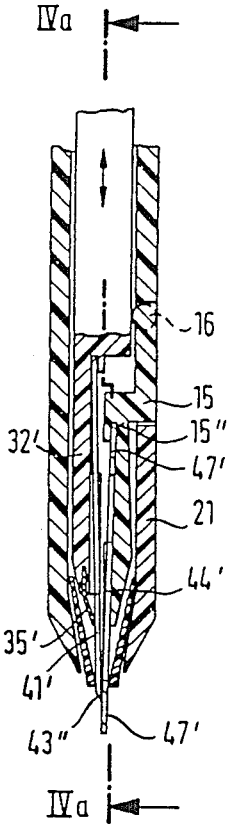

FIG. 1 shows a perspective total view of an embodiment of the device according to the invention in its operating condition;

FIG. 1*a* shows a perspective lateral view of a further embodiment of the device according to the invention in its rest condition;

FIGS. 2 and 2*a* shows perspective drawings of the embodiments according to FIG. 1 respectively 1*a*, exploded into single pieces;

FIGS. 3 and 3*a* show longitudinal sections through the embodiments shown in FIGS. 1 and 1*a* respectively;

FIGS. 4 and 4*a* show in a magnified drawing a longitudinal section along the line IV—IV in FIG. 5 and along the line IV*a*—IV*a* in FIG. 5*a*, respectively and FIGS. 5 and 5*a* show sectional views along the line V—V in FIG. 1 and along the line Va—Va in FIG. 1*a* respectively.

On the basis of FIGS. 1 to 5*a*, the construction and the association as well as the interaction of the single parts of two embodiments of the device according to the invention for trimming, cutting out and cutting of wallpaper of any kind is described. If the embodiments differ from each other, the differing parts are marked with the same reference sign, however with an additional apostrophe (') added to the reference sign, which is usually put behind the reference sign in parenthesis.

The device is provided with a front and a rear housing part 1 (1') and 2 (2') respectively; in a circular-shaped chamber 10 of the front housing part 1 (1') a motor 6 is placed, from which a shaft stub 61 (61') protrudes to the left side, as can be seen in FIGS. 2 to 3*a*, which is eccentrically arranged with respect to the center driving shaft (not surther illustrated) of the motor 6 and connected to it. As shown in FIGS. 3 and 3*a*, on the upper left side in the circularly shaped chamber 10, a projection 19 with a protruding pivot is provided, which interengages into a drilled hole 64 of the motor housing (not further designated), so that the motor is held nonrotatably in chamber 10. In the shown embodiment two batteries 7 are placed as an energy source in a circular shaped chamber 20 (20') of the rear housing part 2 (2').

As can be particularly seen in FIGS. 3 and 3*a*, in the front housing part 1 (1') a transfer part 3 is arranged, which has at its upper end in FIGS. 2 to 3*a* an aperture 31 for the reception of the eccentrically arranged shaft stub 61 (61'). Three parallel running elevations 33 or one circular shaped elevation 34 with a semicircular extension 34' and an extension nose 34'' are provided at the other end (i.e. the lower end) of the transfer part in FIGS. 2 to 3*a* for the reception of a specially constructed knife 41 (41'). The knife 41 has, as can be particularly seen in FIGS. 2 and 3, two cutting zones 43 with bilaterally bevelled cutting edges 43', as well as two parallel running connection bars 42 by means of which the two cutting zones 43 are linked with each other. In contrast, the approximately rectangular knife 41' has on both narrow sides bilaterally rounded cutting edges 43'', as well as a circular shaped recess 42' with two semicircular recesses 42''.

A reception part 15 (15') is arranged at the front housing part 1 (1') approximately opposite to the knife 41 (41') which is attached to the lower end of the transfer part 3, the reception part 15 (15'), being swingable around the axis 16 which is placed in the front housing part 1 (1'). As displayed in FIGS. 2, 2*a*, 4 and 4*a*, on both ends the knives 44 (44') have two Z-shaped zones 46 symmetrically arranged to the longitudinal center line 44'', their bevelled edges being shaped as cutting edges 47. Similarly as in knife 41, with the knife 44 both the Z-shaped zones 46 are linked with two parallel running connection bars 45, whereas with knife 44' a circular recess 45' with two semicircular noses 45'' is formed in the connecting part. The side of the reception part 15 (15') which is turned toward the transfer part 3 has, recesses 32 and the elevations 33 in one embodiment, and the elevations 34 and the extensions in the other embodiment, the elevations and extensions being formed in such a manner that the knives 44 (44') are kept stably in the corresponding reception part 15 (15').

Beneath the circular chamber 20 (20') in which the batteries 7 are placed, a substantially L-shaped leaf spring 8 (8') is arranged in the rear housing part in such a manner as can be seen in the sectional view of FIGS. 3 and 3*a*. The leaf spring 8 (8') has a shorter leg 81 (81'), which rests against one pole of the right battery 7 in FIG. 3 or 3*a*. The free front end 82 (82') of the leaf spring 8 (8') is bent downwardly in the shape of a hook. The hook-shaped front end 82 of the spring rests against an elevation 52 of a trigger part 5, whereas the free front end 82' of the long leg 80 (80') of the spring 8' rests against a bevel of the trigger part 5' which is not any further designated; the trigger part 5 (5') is arranged in the lower front zone of the rear housing part 2 (2'), as can be equally seen in FIGS. 3 and 3*a* respectively. The leaf spring 8' includes along its long leg 80' two sidewise bent attachments 83' which prevent sliding out from the guiding slit in the housing 2' in the chamber region 20'.

The trigger part 5 (5') is laterally seen formed in the shape of an "S", as can be especially seen in FIGS. 2 to 3a, and installed (see FIG. 3) it has a horizontally running operating part 51 (51') which is arranged beneath the chamber 20 (20'), and on its other end it has an equally approximately horizontally running covering part 55 (55'') with a slot 54 (54') for the reception of both the knives 41 and 44 (41' and 44'). On the trigger part 5 opposite to the elevation 52 an incision 53 is formed into which, during the rest position of the device according to the invention which is shown in FIG. 3, an extension 22' interengages, which is constructed at an inner bevel 22 of the rear housing part 2. In the trigger part 5' at the spot which corresponds to the incision 53 of the trigger part 5 there are, in contrast, two incisions 53'. Furthermore, the rear housing part 2 has, in plan view, an approximately parallelogram-shaped recess 21', which is limited by the bevel 22, a lower part 21 and a part beneath chamber 20 (20'). The lower part 21 includes edge 26 which points outwardly from recess 21' of the cutting tool.

At the front housing part 1 guide extensions 18 as well as holding noses 12 are provided which are guided into guide groove 24 and/or 23 and snap as well into a recess 23' on the linking of the housing parts 1 and 2. The front housing part 1' in contrast is provided with two hook-shaped noses 10'' with holding noses as well as guide extensions 18' on the inner side in the lower part of the same housing part 1'. The rear housing part 2' is provided with matching interlocking noses 12' in addition to the hook-shaped noses 10'' as well as guide grooves 24' in the lower part of the rear housing part 2'. On the linking of both housing parts the guide extensions 18' are guided in the guide grooves 24' and the interlocking noses 12' are snapped behind the hook-shaped noses 10''.

Furthermore, a first rounded contact sheet metal 62 (downwardly) projecting over the housing of the motor 6 can be seen in FIGS. 2 (2a) and 3 (3a) and a second rounded contact sheet metal 63 can be seen in FIG. 3 (3a), against which in FIG. 3 (3a), the positive pole of battery 7, which is arranged on the left side, rests.

In FIG. 3 (3a) the rest position of the trigger part 5 (5') is shown by means of unbroken lines. In this position of the trigger part 5 (5'), both knives 41 and 44 (41' and 44') are received in the slot 54 (54') of the covering part 55 (55') as can be seen in FIGS. 4 (4a) and 5 (5a). In the rest position of the operating part 5 (5') shown in FIG. 3 (3a) the knives 41 (41') and 44 (44') are placed in the covering part 55 (55'') in such a manner that no part of the two knives 41 (41'), 44 (44') projects over the lower edge 55' of the covering part 55 (55'').

If the trigger part 5 (5') is pressed into the housing in the direction which is indicated by an arrow 9, first the incision 53 of the operating part 5 or the upper incision 53' of the operating part 5', is disengaged from the extension 22' (22'') at the inner bevel 22 of the rear housing part 2 (2'). At the same time that the operating part 5 (5') is being shifted in the direction of arrow 9, the lower hook-shaped end 82 (82') of the leaf spring 8 (8') is pressed upwardly. As soon as the operating part 5 is back in the position which is indicated in FIG. 3 in dash-dotted line, the hook-shaped front end 82 of spring 8 comes into the equally indicated position (dash-dotted line), in which its upper front end rests against the first contact sheet metal 62. The same applies correspondingly to the operating part 5' and the spring 8', although there is no dash-dotted operating position shown in FIG. 3a. As soon as the front end 82 (82') of spring 8 (8') is resting against the contact sheet metal 62, motor 6 is turned on. Actuated by means of the eccentrically arranged shaft stub 61 which is connected to the motor shaft and projects into the incision 31, the transfer part 3 then carries out a downwardly and upwardly directed lifting movement within the extent of 1.5 to 3 mm. Because of this lifting movement of the transfer part 3 the knife 41 (41') which is attached to its lower end is moved up and down. When, in FIG. 3a, the trigger part 5' is pressed farther up in the direction of arrow 9 through use of the operating part 5' until the extension 22'' interengages with the lower one of the incisions 53', the device according to the invention is in continuous operation. In order to stop the continuous operation, the operation part 51' in FIG. 3a only has to be shifted to the right so that the extension 22'' is disengaged from the lower one of the two incisions 53'.

During the shifting of the trigger part 5 (5') in direction of the arrow 9 both knives 41 and 44 (41' and 44') project over the edge 55' of the covering part 55 so that a scissor-movement is carried out between the knife 41 (41') which is moved by the transfer part 3 and the resiliently resting knife 44 (44'), which is firmly held in the first housing part. Whereas in the embodiment according to FIGS. 1 to 5 the movable knife 41 rests resiliently against the stationary knife 44, in the embodiment according to FIGS. 1a to 5a an additional, resilient pressing part 35' is provided by means of which, during a lifting movement of the transfer part 3, the knife 41' is pressed against the stationary knife 44' where the movable knife 41 then slides along.

If one tip of the Z-shaped zones 46 of the firm knife 44 (44') is now moved beneath a wallpaper which has just been applied and when the device according to the invention is being moved, for example along a transition edge between wall and ceiling on this spot the projecting wallpaper is neatly cut along a straight running cutting line. Since the Z-shaped zones 46 of the stationary knives 44 (44') are each provided with a point on both ends, the device according to the invention can be moved away or towards the user. Correspondingly, incisions or cutouts can be made on a wallpaper which, for example, has just been applied. In this case, the wallpaper is pierced at the desired spot by means of one of the two points of the Z-shaped zones 46 of the stationary knife 44 (44') and moved along the desired cutout.

For turning around or exchanging the two knives 41 (41') or 44 (44') with the device according to the invention, both the housing parts 1 (1') and 2 (2') can be easily separated from each other. As soon as the upper of the two supporting noses is pressed for this purpose in the embodiment according to FIGS. 1 to 5, the front housing part can then be removed by lifting it, the guide extensions 18 of the front housing part 1 gliding in the rear housing part 2; at the same time the extension 10' at the upper rear end of the front housing part 1 is removed from the corresponding cutout 25 at the rear housing part 2. In the embodiment according to FIG. 1a to 5a, two arrows I and II are shown in FIG. 1a which indicate that in order to separate the two housing parts 1' and 2' from each other, the housing part 1' must first be moved in the direction of the arrow I and then in the direction of the arrow II, so that the hook-shaped nose 10'' is disengaged from the interlocking noses 12'. During the shift or the housing part 1' in the direction of the arrow II the guide extensions 18' glide into the guide grooves 24'.

When the front housing part 1 (1') has been separated in the described way from the rear housing part 2 (2'), the reception part 15 (15') is swung toward the stationary knife 44 (44') as shown in FIG. 2 (2*a*). In this way, not only is the access to the stationary knife 44 (44') fastened in the reception part 15 (15') ensured, but also to the movable knife 41 (41') which is fastened at the lower end of the transfer part 3.

Furthermore, dead batteries 7 can be exchanged if the front housing part 1 is lifted from the rear housing part 2. As soon as the knife or the knives 41, 44 (41', 44') have been exchanged, and eventually also dead batteries 7 have been substituted by new ones, the guide extensions 18 (18') are introduced into the guide groove 24 (24') of the respective housing parts 1 (1') and 2 (2') respectively until the lower of both interlocking noses 12 snaps in the recess 23' of the housing part 2 and until at the same time the extension 10' rests in the cutout 25, or the interlocking noses 12' snap in behind the hook-shaped noses 10''. Furthermore, during the shift of the guides 18 (18') in the grooves 24 (24') it has to be considered, that both the knives 41 (41') and 44 (44') resting on each other are introduced exactly into the breakthrough 54 (54') in the covering part 55 (55') of the trigger part 5 (5'). As soon as the lower interlocking nose 12 snaps into the recess 23 and the extension 10' lies in the cutout 25, or the interlocking noses 12' snap in behind the noses 10'', the device according to the invention is operational.

Thus, the invention has created a handy and easily operational device consisting of few parts which can be easily assembled, through use of which wallpaper, particularly wallpaper of any kind which has just been applied, can be trimmed, cut out and cut without any difficulties and which, in addition, makes it possible that knives that have become dull can be substituted by means of few manual steps avoiding the use of additional tools. In the same way used up batteries can be substituted by new ones without any difficulties. The same applies to the exchange of the electric motor used as a drive, in case it has become useless or failed, for example, due to improper use or overloading.

I claim:

1. A device for cutting of wallpaper, comprising
a housing having a chamber therein,
a motor within said chamber,
a drive shaft connected to said motor for carrying out eccentric rotary motion,
a transfer part connected to said drive shaft for converting the eccentric rotary motion of said drive shaft to reciprocating motion,
a first knife mounted on said transfer part for carrying out reciprocating motion,
a second knife mounted on said housing and cooperating with said first knife for cutting said wallpaper, and
a trigger part mounted in said housing and comprising cover means and actuation means, said trigger part being shiftable between first and second positions, said trigger part covering a cutting portion of said first and second knives when in said first position, said trigger part exposing said cutting portion of said first and second knives and actuating said motor to cut said wallpaper when in said second position.

2. The device of claim 1 further comprising an electrical energy source for powering said motor.

3. The device of claim 1 wherein said second knife includes at least one Z-shaped area, said Z-shaped area including a reversion area which comprises a cutting edge for cutting wallpaper received within said reversion area.

4. The device of claim 1 further comprising a spring for spring-loading said trigger part, said spring biasing said trigger part into said first position.

5. A device for cutting of wallpaper, comprising
a housing having a chamber therein, said housing including interconnected front and rear parts,
a motor within said chamber,
an electrical energy source for powering said motor,
a drive shaft connected to said motor for carrying out eccentric rotary motion,
a transfer part connected to said drive shaft for converting the eccentric rotary motion of said drive shaft to reciprocating motion,
a first knife mounted on said transfer part and carrying out reciprocating motion,
a second knife mounted in said front part of said housing and cooperating with said first knife for cutting said wallpaper, said second knife remaining stationary relative to said first knife,
said second knife including two substantially Z-shaped areas along two of its sides, said Z-shaped areas including reversion areas which comprise cutting edges for cutting wallpaper received within said reversion areas, and
a trigger part mounted in said housing, said trigger part comprising cover means and actuation means, said trigger part being shiftable between first and second positions, said trigger part covering a cutting portion of said first and second knives when in said first position, said trigger part exposing said cutting portion of said first and second knives and actuating said motor to cut said wallpaper when in said second position.

6. The device of claim 5 wherein said first knife includes a cutting edge having two bevelled ends.

7. The device of claim 5 further comprising a reference edge formed as a portion of said rear part of said housing.

8. The device of claim 5 wherein said first and second knives are detachable and replaceable.

9. The device of claim 5 wherein said trigger part is substantially S-shaped and includes an operating part at one end thereof, and a covering part having a slot therein for receiving said first and second knives at another end thereof.

10. The device of claim 5 further comprising a spring for spring-loading said trigger part, said spring being an L-shaped leaf spring, and including a shoft leg resting on a pole of said electric energy source, a long leg, and a hook-shaped curved part which biases said trigger part into said first position.

11. The device of claim 10 wherein said spring includes extension pieces for securing said spring into said rear part of said housing.

12. The device of claim 5 wherein said front part of said housing includes guiding extensions and holding noses for interconnection with said rear part of said housing.

13. The device of claim 12 wherein said rear part of said housing includes guiding grooves and guiding extension members for cooperation with said guiding extensions and holding noses of said front part of said housing.

14. The device of claim 5 wherein said front part of said housing includes receiving means for receiving said stationary knife, said receiving means being swingable outward relative to said front part of said housing.

15. The device of claim 5 wherein said first and second knives include mounting means comprising circularly shaped apertures with off-center noses.

16. The device of claim 5 wherein said second knife includes four Z-shaped areas symmetrically disposed about a central axis, and wherein said knife is shaped slightly concave.

17. The device of claim 5 further comprising pressure applying means for pressing said first knife resiliently against said second knife.

* * * * *